US011178922B1

(12) United States Patent
Allen

(10) Patent No.: US 11,178,922 B1
(45) Date of Patent: Nov. 23, 2021

(54) WEARABLE ILLUMINATION DEVICE

(71) Applicant: Larry Allen, Strasburg, OH (US)

(72) Inventor: Larry Allen, Strasburg, OH (US)

( * ) Notice: Subject to any disclaimer, the term of this patent is extended or adjusted under 35 U.S.C. 154(b) by 0 days.

(21) Appl. No.: 16/903,950

(22) Filed: Jun. 17, 2020

(51) Int. Cl.

| | |
|---|---|
| ***A41D 13/01*** | (2006.01) |
| ***F21S 10/06*** | (2006.01) |
| ***F21S 9/04*** | (2006.01) |
| ***A41D 1/00*** | (2018.01) |
| ***A41D 27/08*** | (2006.01) |

(52) U.S. Cl.
CPC ..... *A41D 13/01* (2013.01); *A41D 1/002* (2013.01); *A41D 27/085* (2013.01); *F21S 9/04* (2013.01); *F21S 10/06* (2013.01)

(58) Field of Classification Search
CPC ..... F21V 33/0008; A41D 13/01; A41D 1/002; A41D 27/085
See application file for complete search history.

(56) References Cited

U.S. PATENT DOCUMENTS 5,128,843 A * 7/1992 Guritz ..... A41D 27/085 362/103
5,630,382 A * 5/1997 Barbera ..... A01K 27/006 119/859
5,690,411 A * 11/1997 Jackman ..... A41D 13/01 362/103
5,984,488 A * 11/1999 Tung ..... A41D 13/01 362/108
6,106,130 A * 8/2000 Harding ..... A41D 13/01 362/103
6,267,482 B1 * 7/2001 Miller ..... A41D 13/01 362/103
6,517,214 B1 * 2/2003 Mitchell, Jr. ..... A41D 13/01 2/94
8,616,719 B1 * 12/2013 Barze ..... A41D 13/01 362/108
10,918,965 B1 * 2/2021 Kelly ..... F21V 5/00
2008/0043458 A1 * 2/2008 Desjardin ..... G08B 5/004 362/108
2012/0318985 A1 * 12/2012 Bushee ..... A01K 27/006 250/342
2014/0078773 A1 * 3/2014 Curran ..... F21V 33/0008 362/555
2014/0355257 A1 * 12/2014 Anteby ..... A41D 13/01 362/108
2016/0100641 A1 * 4/2016 Payne ..... G06F 3/165 381/333
2018/0073168 A1 * 3/2018 Gladish ..... H02J 7/0068
2018/0242658 A1 * 8/2018 Dal Lago ..... G09F 9/305
2019/0104777 A1 * 4/2019 Lauf ..... A41D 13/01
2019/0166933 A1 * 6/2019 Tiffin ..... A41D 19/0024
2020/0315269 A1 * 10/2020 Roberts ..... F21V 33/0008
2020/0355361 A1 * 11/2020 Bryant ..... F21K 9/238

* cited by examiner

*Primary Examiner* — William N Harris
(74) *Attorney, Agent, or Firm* — The Iwashko Law Firm, PLLC; Lev Ivan Gabriel Iwashko

(57) ABSTRACT

A wearable illumination device, including a main body to be disposed on a body of a user, a plurality of lights disposed on and within at least a portion of the main body to illuminate a surrounding area, the plurality of lights including a plurality of flashing portions disposed on and within at least a portion of the main body to illuminate the surrounding area, such that the plurality of flashing portions flash, and a power source disposed on at least a portion of the main body to provide power to the plurality of lights.

7 Claims, 3 Drawing Sheets

WEARABLE ILLUMINATION DEVICE

BACKGROUND

1. Field

The present general inventive concept relates generally to an illumination device, and particularly, to a wearable illumination device.

2. Description of the Related Art

Often times, workers, such as construction workers and/or first responders, including police and/or a fire and rescue worker need to work in an area with low light and/or no light. As such, the workers assume a heightened risk of danger and/or injury because they cannot see around themselves and/or other people cannot see them.

Under those circumstances, safety vests are articles of clothing designed to enhance the visibility of the workers. However, the safety vests can be uncomfortable to wear and can easily get tangled up with other objects. Also, the safety vests are usually limited to relying on specific colors for a third party to recognize the workers performing safety related work. Unfortunately, the third party may not quickly recognize the specific colors quickly enough before causing injury to the workers.

Therefore, there is a need for a wearable illumination device to improve the safety of any type of worker.

SUMMARY

The present general inventive concept provides a wearable illumination device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a wearable illumination device, including a main body to be disposed on a body of a user, a plurality of lights disposed on and within at least a portion of the main body to illuminate a surrounding area, the plurality of lights including a plurality of flashing portions disposed on and within at least a portion of the main body to illuminate the surrounding area, such that the plurality of flashing portions flash, and a power source disposed on at least a portion of the main body to provide power to the plurality of lights.

The main body may include a top portion perpendicularly disposed at an end away from the power source with respect to a first direction to cover at least a portion of a back, shoulders, and a chest of the user, and a bottom portion perpendicularly disposed at an end away from the power source with respect to a second direction opposite to the first direction to cover at least a portion of the back of the user.

The main body may further include a chest strap disposed on at least a portion of the top portion to connect around the chest of the user.

Each of the plurality of lights may be disposed at a first distance from another light of the plurality of lights, and each light of the plurality of flashing portions may be disposed at a second distance from another light of the plurality of flashing portions, such that the second distance may is less than the first distance.

The plurality of flashing portions may be disposed at a third distance from the plurality of lights, such that the third distance is greater than the first distance.

The wearable illumination device may further include a reflective lining disposed on an outer edge of the main body to reflect light received thereon.

The power source may be a piezoelectric unit that generates power in response to movement of the main body.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Wearable Illumination Device 100
Main Body 110
Top Portion 111
Bottom Portion 112
Chest Strap 113
Lights 120
Flashing Portions 121
Reflective Lining 130
Power Source 140
Fasteners 150
Adjustment Straps 160
Light Button 170

Figure 1A:
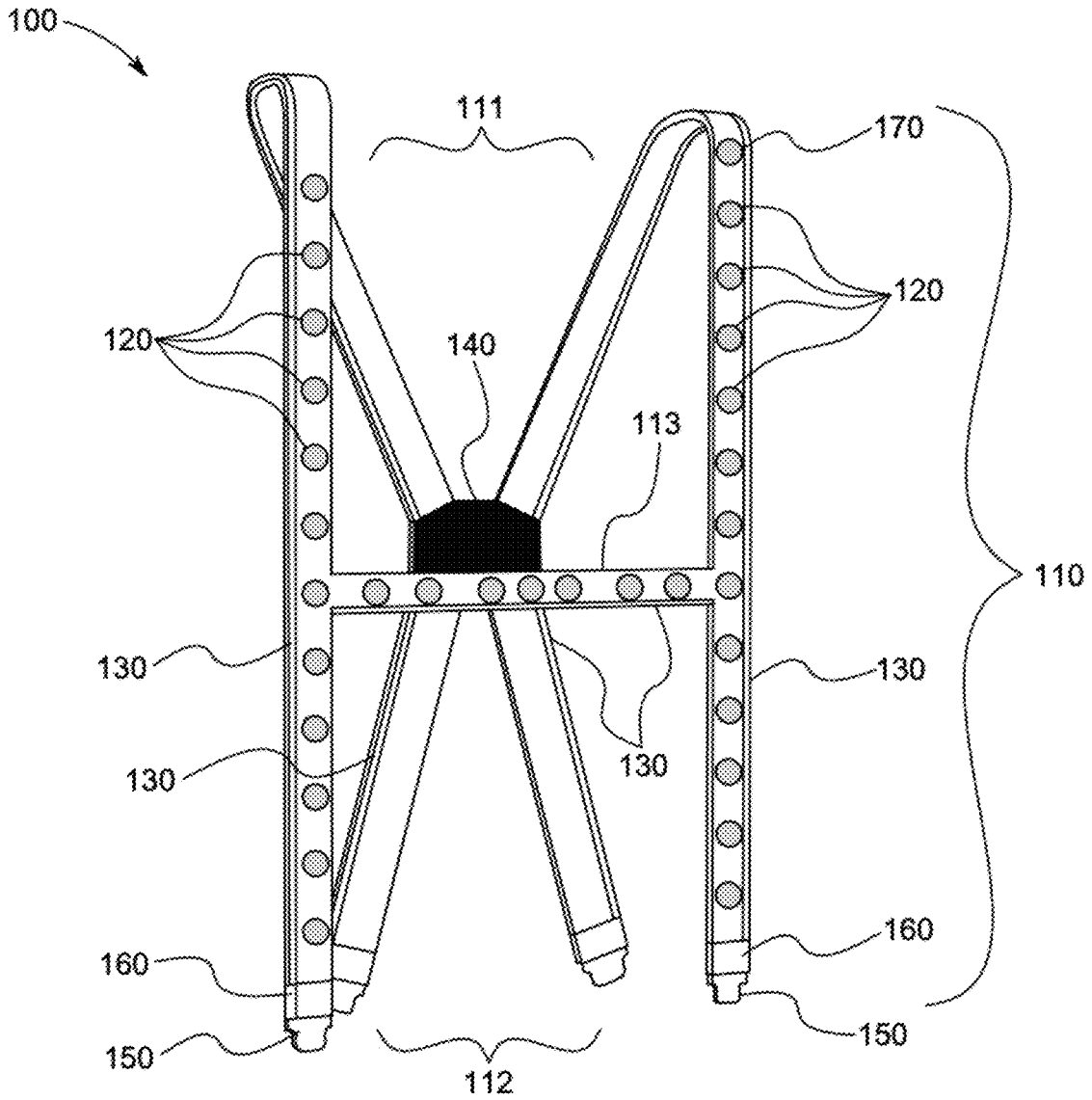
FIG. 1A illustrates a front perspective view of a wearable illumination device, according to an exemplary embodiment of the present general inventive concept.

FIG. 1A illustrates a front perspective view of a wearable illumination device 100, according to an exemplary embodiment of the present general inventive concept.

Figure 1B:
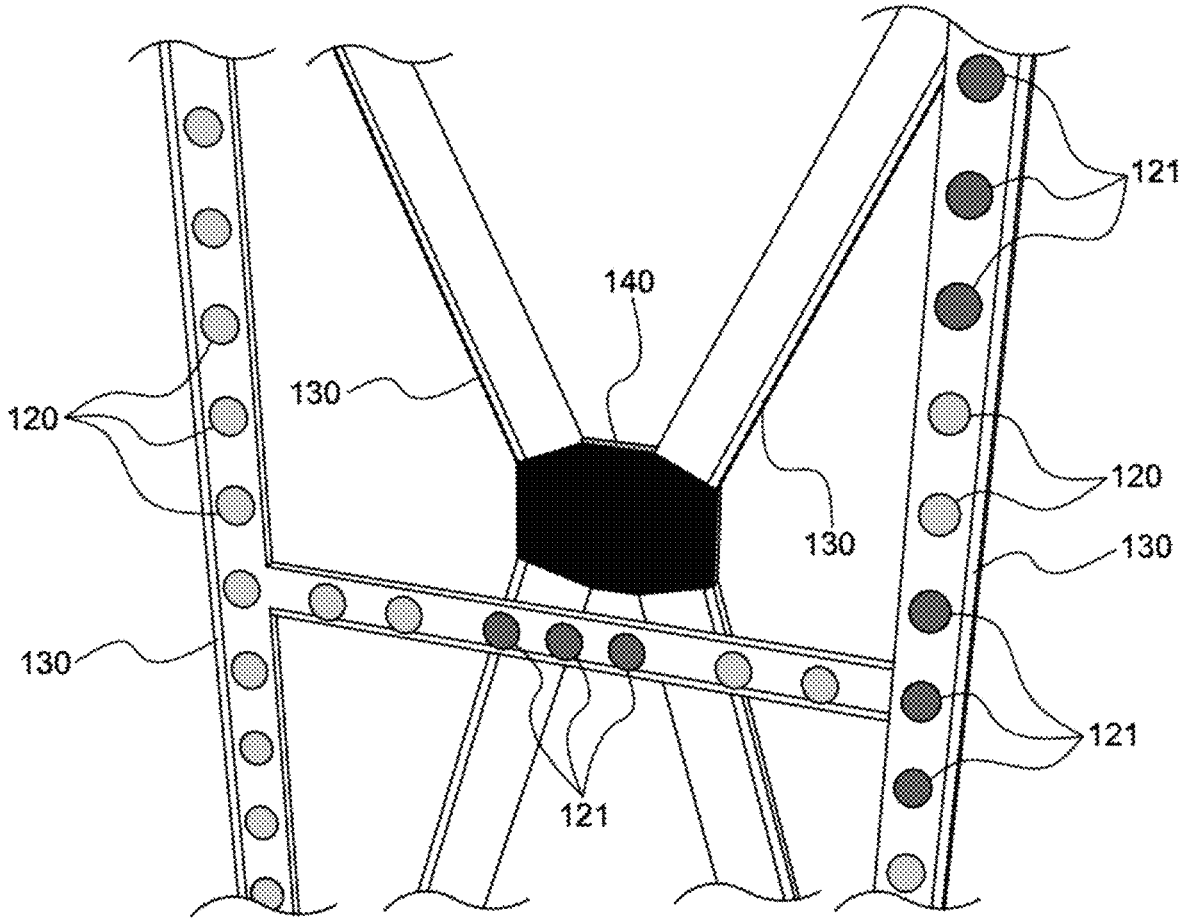
FIG. 1B illustrates a zoomed in view of a chest strap of the wearable illumination device, according to an exemplary embodiment of the present general inventive concept.

FIG. 1B illustrates a zoomed in view of a chest strap 113 of the wearable illumination device 100, according to an exemplary embodiment of the present general inventive concept.

The wearable illumination device 100 may be constructed from at least one of cloth, metal, plastic, glass, and rubber, etc., but is not limited thereto. Additionally, the wearable illumination device 100 may be highly durable to resist damage from a physical impact. Furthermore, the wearable illumination device 100 may be waterproof and/or fireproof.

The wearable illumination device 100 may include a main body 110, a plurality of lights 120, a reflective lining 130, a power source 140, a plurality of fasteners 150, a plurality of adjustment straps 160, and a light button 170, but is not limited thereto.

Referring to FIGS. 1A and 1B, the main body 110 is illustrated to be suspenders, such that the main body 110 may be worn over clothing and/or a body of a user. However, the main body 110 may be a shirt, a vest, a tank top, and/or any other type of clothing based on a preference of the user and/or a manufacturer.

The main body 110 may include a top portion 111, a bottom portion 112, and a chest strap 113, but is not limited thereto.

Referring again to FIG. 1A, a length of the top portion 111 is illustrated to be greater than a length of the bottom portion 112. Alternatively, the length of the top portion 111 may be equivalent and/or less than the length of the bottom portion 112.

The chest strap 113 may include hooks and loops, a buckle, a twine, a string, a rope, a magnet, a clasp, a hook, a screw, a nail, a bolt, a nut, a washer, and/or any combination thereof, but is not limited thereto.

The chest strap 113 may be optionally disposed on a first strap of the top portion 111 and/or a second strap of the top portion 111. The chest strap 113 may connect between the first strap and/or the second strap of the top portion 111 around a chest of the user. As such, the chest strap 113 may prevent the first strap and/or the second strap of the top portion 111 from falling off the chest of the user.

The plurality of lights 120 may include a plurality of flashing portions 121, but is not limited thereto.

Each of the plurality of lights 120 may include an incandescent light and a light-emitting diode (LED), but is not limited thereto.

The plurality of lights 120 may be disposed on and/or within at least a portion of the main body 110. The plurality of lights 120 may illuminate a surrounding area using a steady light. Also, the plurality of lights 120 may illuminate a first variety of colors. As such, the plurality of lights 120 may facilitate viewing of the surrounding area during a low light and/or a no light condition by the user.

Referring again to FIGS. 1A and 1B, although, each of the plurality of lights 120 are illustrated as individual lights, each of the plurality of lights 120 may be a strip of light and/or a matrix of small lights disposed on and/or within the main body 110.

Referring again to FIG. 1B, the plurality of flashing portions 121 may be disposed at portions along the main body 110. The plurality of flashing portions 121 may illuminate the surrounding area using a second variety of colors. The second variety of colors may be different and/or the same as the first variety of colors. Additionally, the plurality of flashing portions 121 may flash and/or blink, such that the user and/or a third party may readily notice the plurality of flashing portions 121.

Moreover, the plurality of flashing portions 121 may be disposed differently with respect to other portions of the plurality of lights 120. More specifically, the plurality of flashing portions 121 may include lights disposed at a smaller distance from other lights of the plurality of flashing portions 121, compared to a distance of each light of the plurality of lights 120. Additionally, the plurality of flashing portions 121 may be disposed at a greater distance from the plurality of lights 120.

In other words, each of the plurality of lights 120 may be disposed at a first distance from another light of the plurality of lights 120. Each light of the plurality of flashing portions 121 may be disposed at a second distance from another light of the plurality of flashing portions 121, such that the second distance is less than the first distance. Furthermore, the plurality of flashing portions 121 may be disposed at a third distance from the plurality of lights 120, such that the third distance is greater than the first distance. The difference in distances may distinguish to the third party viewing the plurality of lights 120 of a purpose and difference in each of the plurality of lights 120 and/or the plurality of flashing portions 121.

Referring again to FIGS. 1A and 1B, the reflective lining 130 is illustrated to be disposed on an outer edge of the main body 110. However, the reflective lining 130 may be disposed on an inner edge of the main body 110 and/or dispersed on and/or within any portion of the main body 110. The reflective lining 130 may reflect light received thereon from the plurality of lights 120, the plurality of flashing portions 121, and/or an external light source, such that the reflective lining 130 may increase visibility of the main body 110 and/or the user.

Figure 2:
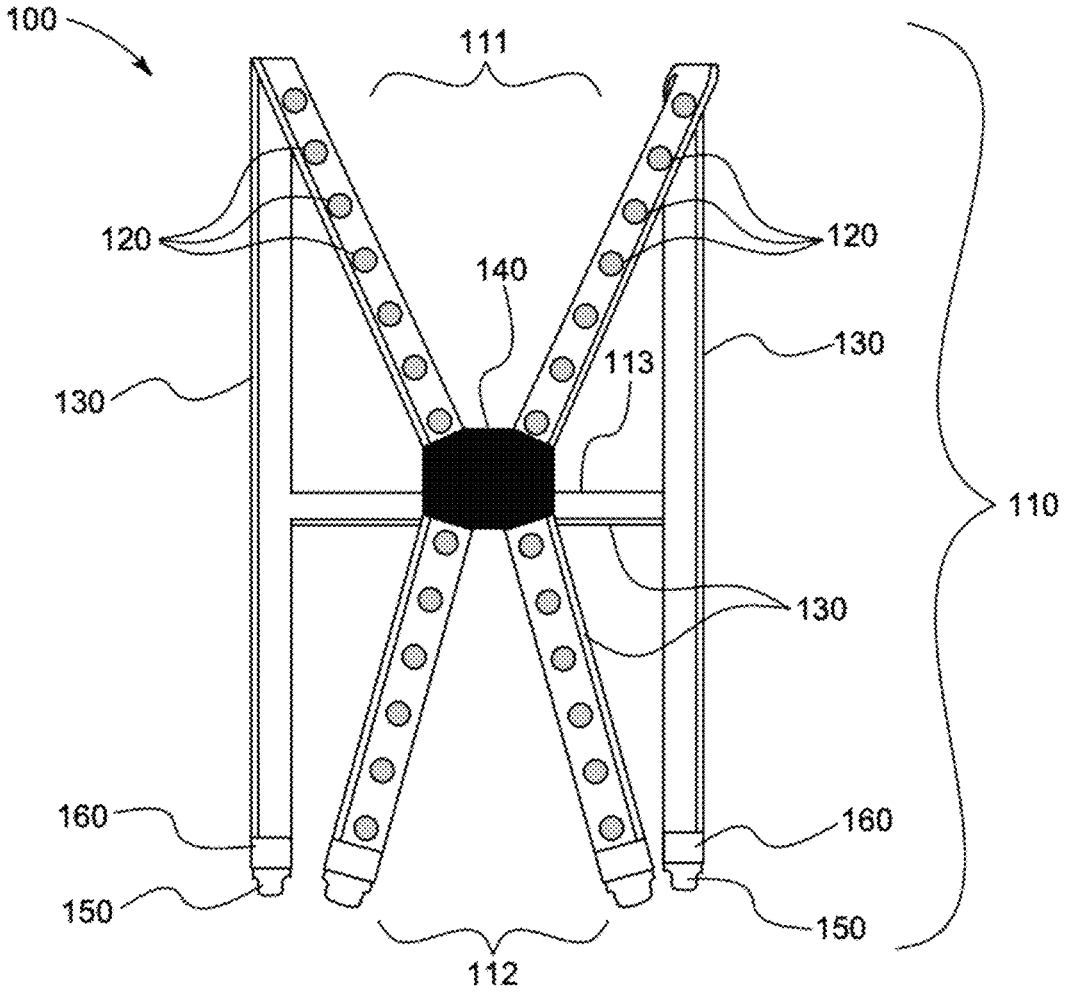
FIG. 2 illustrates a rear perspective view of the wearable illumination device, according to an exemplary embodiment of the present general inventive concept.

FIG. 2 illustrates a rear perspective view of the wearable illumination device 100, according to an exemplary embodiment of the present general inventive concept.

The power source 140 may include a battery, a solar cell, a storage compartment, and a piezoelectric unit, but is not limited thereto.

The power source 140 may be octagonal shaped to resemble a stop sign, which is customarily known to be a symbol for stopping and/or caution. As such, the power source 140 may increase safety of the user by indicating to the third party a need to increase attention to the user. However, the power source 140 may be a rectangular prism, circular, conical, pentagonal, hexagonal, heptagonal, and/or any other shape known to one of ordinary skill in the art.

The solar cell of the power source 140 may charge the battery therein in response to receiving light from the external light source. Alternatively, the piezoelectric unit of the power source 140 may charge the battery therein in response to receiving energy based on movement of the main body 110 and/or the power source 140, such as due to movement by the user. In other words, the piezoelectric unit of the power source 140 may generate power in response to movement of the main body 110.

The storage compartment of the power source 140 may store at least one item therein. For example, the storage compartment may store a global positioning system (GPS) unit therein.

A first end of the top portion 111 of the main body 110 may be perpendicularly disposed away from a top portion of the power source 140 with respect to a first direction. A first end of the bottom portion 112 of the main body 110 may be perpendicularly disposed on at least a portion of a bottom portion of the power source 140 with respect to a second direction opposite with respect to the first direction. In other words, the power source 140 may be disposed between the top portion 111 and/or the bottom portion 112.

The top portion 111 may cover on at least a portion of a back, shoulders, and/or the chest of the user. The bottom portion 112 may cover at least a portion of the back of the user. In other words, the main body 110 may be worn over the shoulders of the user as is known for suspenders.

Each of the plurality of fasteners 150 may include a buckle, hooks and loops, a twine, a string, a rope, a magnet, a clasp, a hook, a screw, a nail, a bolt, a nut, a washer, and/or any combination thereof, but is not limited thereto.

The plurality of fasteners 150 may be disposed on at least a portion of a second end of the top portion 111 and/or a second end of the bottom portion 112. The plurality of fasteners 150 may connect to at least one other item (e.g., a pair of pants, a pair of shorts, a skirt, a belt, etc.) worn on a pelvic portion of the user, such that the main body 110 may be prevented from removal from the at least one other item and/or away from the user.

Each of the plurality of adjustment straps 160 may include a buckle, hooks and loops, a twine, a string, a rope, a magnet, a clasp, a hook, a screw, a nail, a bolt, a nut, a washer, and/or any combination thereof, but is not limited thereto.

The plurality of adjustment straps 160 may be disposed on at least a portion of the second end of the top portion 111 and/or the second end of the bottom portion 112. The plurality of adjustment straps 160 may adjust a length of the top portion 111 and/or the bottom portion, such as increasing the length by moving in a first lateral direction, and decreasing the length by moving in a second lateral direction.

As such, the plurality of adjustment straps 160 may adjust the length of the top portion 111 and/or the bottom portion 112 based on the preference of the user.

The light button 170 may be disposed on at least a portion of the main body 110. The light button 170 may be depressed a first time and/or a first duration of time to illuminate the plurality of lights 120. Also, the light button may be depressed a second time and/or a second duration of time to illuminate the plurality of flashing portions 121. The plurality of flashing portions 121 may illuminate with the plurality of lights 120, such that the plurality of flashing portions 121 illuminate a steady light during the first depress of the light button 170. Alternatively, the plurality of flashing portions 121 may remain off until the light button 170 is depressed the second time.

Furthermore, the light button 170 may turn off the plurality of lights 120 and/or the plurality of flashing portions 121 in response to being depressed a third time and/or a third duration of time.

The power source 140 may send power to the plurality of lights 120, the plurality of flashing portions 121, and/or the light button 170.

Therefore, the wearable illumination device 100 may increase safety of the user due to the plurality of lights 120 and the reflective lining 130 illuminating the surrounding area to increase visibility of the user. As such, the wearable illumination device 100 may prevent injury and save a life of the user.

The present general inventive concept may include a wearable illumination device 100, including a main body 110 to be disposed on a body of a user, a plurality of lights 120 disposed on and within at least a portion of the main body 110 to illuminate a surrounding area, the plurality of lights 120 including a plurality of flashing portions 121 disposed on and within at least a portion of the main body 110 to illuminate the surrounding area, such that the plurality of flashing portions 121 flash, and a power source 140 disposed on at least a portion of the main body 110 to provide power to the plurality of lights 120.

The main body 110 may include a top portion 111 perpendicularly disposed at an end away from the power source 140 with respect to a first direction to cover at least a portion of a back, shoulders, and a chest of the user, and a bottom portion 112 perpendicularly disposed at an end away from the power source 140 with respect to a second direction opposite to the first direction to cover at least a portion of the back of the user.

The main body 110 may further include a chest strap 113 disposed on at least a portion of the top portion 111 to connect around the chest of the user.

Each of the plurality of lights 120 may be disposed at a first distance from another light of the plurality of lights 120, and each light of the plurality of flashing portions 121 may be disposed at a second distance from another light of the plurality of flashing portions 121, such that the second distance may is less than the first distance.

The plurality of flashing portions 121 may be disposed at a third distance from the plurality of lights 120, such that the third distance is greater than the first distance.

The wearable illumination device 100 may further include a reflective lining 130 disposed on an outer edge of the main body 110 to reflect light received thereon.

The power source 140 may be a piezoelectric unit that generates power in response to movement of the main body 110.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A wearable illumination device, comprising:

a main body to be disposed on a body of a user, such that the main body is constructed as suspenders having a plurality of elongated straps, such that the plurality of elongated straps are linearly connected at a front portion to prevent the plurality of elongated straps from separating;

a plurality of lights disposed on and within a full length of each of the plurality of elongated straps to illuminate a surrounding area, the plurality of lights comprising:

a plurality of flashing portions disposed on and within at least a portion of the main body to illuminate the surrounding area, such that the plurality of flashing portions flash; and an octagonal shaped power source disposed on at least a portion of the main body to provide power to the plurality of lights, such that the octagonal shape symbolizes caution.

2. The wearable illumination device of claim 1, wherein the main body comprises:

a top portion perpendicularly disposed at an end away from the power source with respect to a first direction to cover at least a portion of a back, shoulders, and a chest of the user; and a bottom portion perpendicularly disposed at an end away from the power source with respect to a second direction opposite to the first direction to cover at least a portion of the back of the user.

3. The wearable illumination device of claim 2, wherein the main body further comprises:

a chest strap disposed on at least a portion of the top portion to connect around the chest of the user.

4. The wearable illumination device of claim 1, wherein each of the plurality of lights are disposed at a first distance from another light of the plurality of lights, and each flashing portion of the plurality of flashing portions is disposed at a second distance from another flashing portion of the plurality of flashing portions, such that the second distance is less than the first distance.

5. The wearable illumination device of claim 4, wherein the plurality of flashing portions are disposed at a third distance from the plurality of lights, such that the third distance is greater than the first distance.

6. The wearable illumination device of claim 1, further comprising:

a reflective lining disposed on an outer edge of the main body to reflect light received thereon.

7. The wearable illumination device of claim 1, wherein the power source is a piezoelectric unit that generates power in response to movement of the main body.

* * * * *